US010501274B2

(12) United States Patent
Ramakrishnan et al.

(10) Patent No.: US 10,501,274 B2
(45) Date of Patent: Dec. 10, 2019

(54) CONTINUOUS WEB SHEET DEFECT ANALYTICS, CLASSIFICATION AND REMEDIATION FOR ENHANCING EQUIPMENT EFFICIENCY AND THROUGHPUT

(71) Applicant: Honeywell Limited, Mississauga (CA)

(72) Inventors: Balamurugan Ramakrishnan, Dindigul (IN); Gajanan Rothe, Bangalore (IN); Niranjan Rao, Bangalore (IN); Lingathurai Palanisamy, Bangalore (IN); Ajaykumar R Bangur, Bangalore (IN)

(73) Assignee: Honeywell International Inc., Morris Plains, NJ (US)

( * ) Notice: Subject to any disclaimer, the term of this patent is extended or adjusted under 35 U.S.C. 154(b) by 103 days.

(21) Appl. No.: 15/642,683

(22) Filed: Jul. 6, 2017

(65) Prior Publication Data

US 2019/0010005 A1 Jan. 10, 2019

(51) Int. Cl.

| | |
|---|---|
| ***B65H 26/02*** | (2006.01) |
| ***B65H 20/02*** | (2006.01) |
| ***D21G 9/00*** | (2006.01) |

(52) U.S. Cl.

CPC ..... *B65H 26/02* (2013.01); *B65H 20/02* (2013.01); *D21G 9/0009* (2013.01)

(58) Field of Classification Search

CPC ..... G01N 21/89; G01N 21/8903; G01N 21/8983; G01N 2021/8917; G01N 21/8915; G01N 21/8922; G01N 33/346; G01N 2021/8927; G01N 21/8422; G01N 21/86; G01N 21/8901; G01N 25/72; D21G 9/0009; B65H 26/02; B65H 20/02; G06T 2207/30124; G06T 7/001; G06T 2207/1001; D06H 3/00

See application file for complete search history.

(56) References Cited

U.S. PATENT DOCUMENTS

| | | | | |
|---|---|---|---|---|
| 3,670,615 A * | 6/1972 | Scholl | ..... | D06H 1/00 83/367 |
| 3,693,021 A * | 9/1972 | Lake, Jr. | ..... | G01N 21/8916 250/214.1 |
| 3,835,332 A * | 9/1974 | Bridges | ..... | G01N 21/8903 250/559.04 |

(Continued)

FOREIGN PATENT DOCUMENTS

| | | | | |
|---|---|---|---|---|
| CN | 204287062 U | 4/2015 | | |
| EP | 3425112 A1 * | 1/2019 | ..... | B65H 26/02 |

(Continued)

*Primary Examiner* — Jose A Fortuna

(57) ABSTRACT

Monitoring continuous repetitive web sheet defects to determine the causes of such defects by creating unique diagnostic patterns associated with selected components of a web-making machine and employing pattern recognition techniques to analyze and classify web-sheet dynamic and deterministic defect patterns, and identify their root causes. Corrective actions can be effected thereby enhancing machine run-time to minimize late deliveries and improves overall product quality. The technique which is integrated with quality control system can be applied to the manufacturer of paper, packaging, rubber sheets, plastic film, metal foil, and the like.

17 Claims, 7 Drawing Sheets

(56) References Cited

U.S. PATENT DOCUMENTS 3,866,054 A * 2/1975 Wolf ..... G01N 21/8915 250/559.39
4,728,800 A 3/1988 Surka
4,982,600 A 1/1991 Kiso et al.
5,742,398 A * 4/1998 Laucournet ..... D06H 3/08 250/559.46
5,847,753 A * 12/1998 Gabello ..... G01N 21/8903 348/88
6,098,063 A * 8/2000 Xie ..... G06N 5/025 706/60
6,226,088 B1 * 5/2001 Keane ..... D06H 3/08 356/238.2
6,266,437 B1 * 7/2001 Eichel ..... G06T 7/001 348/125
6,539,271 B2 3/2003 Lech et al.
6,753,965 B2 * 6/2004 Kumar ..... G01N 21/8983 356/238.1
7,048,827 B2 5/2006 Watson et al.
7,155,356 B2 * 12/2006 Mantyla ..... D21G 9/0009 702/76
7,297,969 B1 * 11/2007 Wolinsky ..... D21G 9/0009 235/436
7,938,935 B2 5/2011 Machattie et al.
8,060,234 B2 11/2011 Hellstrom et al.
9,309,625 B2 4/2016 Backstrom et al.
9,429,937 B2 * 8/2016 Kent ..... A61F 13/15772
10,331,113 B2 * 6/2019 Kent ..... A61F 13/15772
2002/0066545 A1 * 6/2002 Karjanmaa ..... D21G 9/0009 162/198
2002/0110269 A1 * 8/2002 Floeder ..... G01N 21/89 382/141
2005/0075801 A1 * 4/2005 Skeps ..... G01N 21/8901 702/35
2005/0190367 A1 * 9/2005 Colvill ..... B65H 26/02 356/429
2005/0232475 A1 * 10/2005 Floeder ..... D06H 1/02 382/141
2006/0090319 A1 * 5/2006 Howe ..... G01N 21/8903 29/407.05
2009/0060316 A1 3/2009 Ruuska
2011/0224918 A1 * 9/2011 Floeder ..... D06H 3/08 702/35
2011/0302125 A1 12/2011 Shetty et al.
2012/0147177 A1 * 6/2012 Tam ..... H04N 7/18 348/125
2017/0011317 A1 1/2017 Azad et al.
2019/0010005 A1 * 1/2019 Ramakrishnan ..... B65H 26/02

FOREIGN PATENT DOCUMENTS

JP 2015137923 A 7/2015
WO 2000045156 A1 8/2000

* cited by examiner

CONTINUOUS WEB SHEET DEFECT ANALYTICS, CLASSIFICATION AND REMEDIATION FOR ENHANCING EQUIPMENT EFFICIENCY AND THROUGHPUT

FIELD OF THE INVENTION

The present invention generally relates to techniques for monitoring and controlling continuous web-making systems such as a papermaking machine and more specifically to techniques for detecting repetitive defects on web sheet products, identifying the sources of the defects and initiating corrective measures.

BACKGROUND OF THE INVENTION

In the manufacture of paper on continuous papermaking machines, a web of paper is formed from an aqueous suspension of fibers (stock) on a traveling mesh of papermaking fabric and water drains by gravity and suction through the fabric. The web is then transferred to the pressing section where more water is removed by pressure and vacuum. The web next enters the dryer section where steam heated dryers and hot air completes the drying process. The paper machine is, in essence, a water removal, system. A typical forming section of a papermaking machine includes an endless traveling papermaking fabric or wire, which travels over a series of water removal elements such as table rolls, foils, vacuum foils, and suction boxes. The stock is carried on the top surface of the papermaking fabric and is de-watered as the stock travels over successive de-watering elements to form a sheet of paper. Finally, the wet sheet is transferred to the press section of the papermaking machine where enough water is removed to form a sheet of paper. Many factors affect the quality of the paper produced.

The presence of defects and holes in the papermaking process can be disastrous since even a small hole can catch to result in a roll tear. Most of paper defects are repetitive but if the causes of the defects are not identified and corrected quickly the equipment damage can be extensive, which requires time consuming shut downs and expensive repairs. Current web inspection systems (WIS) can deliver quality data to support decisions that need to be made in subsequent processing steps. Based on web inspection technology, all relevant process images and data are captured and analyzed on-line. Interlinking WIS with events capturing already exists where, in addition to the defects detected, the WIS system also displays the corresponding video sequences recorded by cameras. Unfortunately, existing WISs do not include root cause analysis for repetitive defects which identifies the nature of web sheet defects, their locations relative to the papermaking machine, and the specific sources or names of the equipment that caused the defects. There are no solutions available for non-repetitive defects.

SUMMARY OF THE INVENTION

The present invention is based in part on the recognition that the root causes of repetitive or cyclical web defects can be detected by creating unique diagnostic patterns associated with selected components of the papermaking machine and employing pattern recognition techniques to analyze and classify the moving (dynamic) paper defects and to identify their root causes. Once the locations of the paper defects and the equipment causing the paper defects are identified, corrective actions can be effected to resolve the problem. The invention enhances machine run-time thereby minimizing late deliveries and improves overall product quality.

In web production processes, machine or equipment defects or malfunctions manifest as web defects or deviations. The present invention traces the web defects to the exact equipment components that caused the problems. With respect to papermaking, equipment defects and malfunctions include, for example, the presence of foreign substances adhered to the equipment surface, uneven surfaces due the presence of holes or gaps in clothing (wire or felts) or on rolls (size press or calendar), uneven distribution of moisture, steam, or chemicals by spray nozzles, leaking nozzles, and cutting mechanism (slitter) malfunctions. Such equipment defects result in the production of paper web products that are not within physical and/or chemical property specification.

While the invention will be illustrated as being implemented in papermaking, it is understood that the invention is applicable in other continuous web-making processes such as, for example, in the manufacturer of packaging, rubber sheets, plastic film, metal foil, and the like. A web generally comprises a continuous sheet of moving material that is relatively thin and preferably elongated. The final product is flat and can be stored as rolls of material.

In one aspect, the invention is directed to a process to monitor characteristics of web defects which are continuously generated on a moving web, which is moving in a machine direction (MD), and that is in contact with circulating machine components of a circulating web machine during production and to identify the causes of the web defects, which process includes:

(a) identifying at least one circulating web machine component that can generate corresponding web defect patterns on a continuously moving web of material;

(b) creating one or more diagnostic patterns for the at least one circulating web machine component identified in step (a);

(c) detecting dynamic and deterministic web defect patterns on the continuously moving web of material during production;

(d) identifying the locations along the MD of the dynamic and deterministic web defect patterns on the continuously moving web of material;

(e) correlating detected dynamic and deterministic web defect patterns (preferably by naïve technique) to at least one circulating web machine component; and (f) determining a source of the detected dynamic and deterministic web defect patterns.

In another aspect, the invention is directed to a monitoring process for a continuous web making machine having a wet end which includes a circulating endless wire on which a continuous aqueous sheet of material is formed and a dry end which includes a plurality of devices that transform the continuous aqueous sheet of material that is moving in a machine direction (MD) into a continuous dried sheet product, wherein the monitoring process includes:

(a) identifying an actuator, comprising a rotatable component of the continuous web making machine, that can impart corresponding repetitive web defects onto a continuous moving web of material;

(b) developing a diagnostic pattern for the actuator identified in step (a);

(c) detecting web defects on a continuous moving web material;

(d) analyzing the detected web defects in step (c) to determine whether the detected web defects are repetitive or non-repetitive;

(e) comparing the diagnostic pattern to detected web defects that are repetitive; and (f) identifying a source of web repetitive defects.

In a further aspect, the invention is directed to a system of controlling a web making apparatus in the production of a moving web of material which travels continuously in a machine direction (MD) that includes:

a plurality of actuators that are positioned along the MD wherein each actuator is controllable to vary a property of the moving web of material;

means for measuring a characteristic of the moving web of material to establish web defect patterns of the moving web of material;

means for obtaining a diagnostic defect pattern for at least one of the plurality of actuators; and a controller configured to (i) classify web defect patterns as repetitive or non-repetitive (ii) compare repetitive web defect patterns to the diagnostic defect pattern, and (iii) identify one or more actuators that cause defects on the moving web of material with respect to the characteristic measured.

DETAILED DESCRIPTION OF PREFERRED EMBODIMENTS

Figure 1:
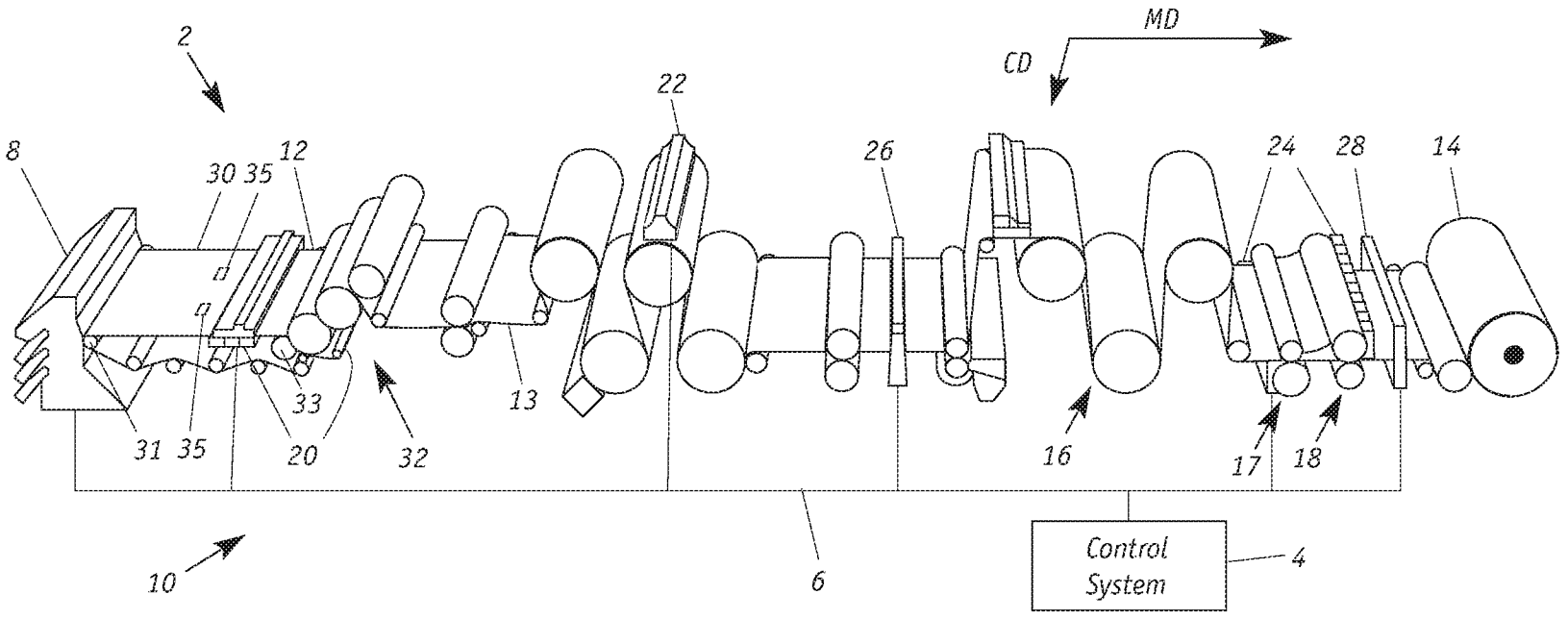
FIGS. 1, 2 and 3 illustrate a papermaking system.

The continuous web sheet defect analytics, classification and remediation will be illustrated by implementing the techniques in a sheet or web making system 10 that includes papermaking machine 2, control system 4 and network 6 as illustrated in FIG. 1. The papermaking machine 2 produces a continuous sheet or web of paper material 12 that is collected in take-up reel 14. The paper material 12, having a specific width, is produced from a pulp suspension, comprising of an aqueous mixture of wood fibers and other materials, which undergoes various unit operations that are monitored and controlled by control system 4. The network 6 facilitates communication between the components of system 10.

The papermaking machine 2 includes a headbox 8, which distributes a pulp suspension uniformly across the machine onto a continuous moving screen or wire 30 that moves in the machine direction (MD). The wire 30 is typically an open mesh material that can be made of metal such woven bronze or copper. Alternatively, the wire can be made of synthetic materials such as plastics (polyamides), in which case the wire is often referred to as a fabric. Headbox 8 includes any suitable structure for distributing a dilute, aqueous pulp suspension and includes a slice opening through which the pulp suspension is distributed onto moving screen or wire 30 which comprise a suitable structure such as a mesh for receiving a pulp suspension and allowing water or other materials to drain or leave the pulp suspension. The wire 30 is driven by and supported on motorized rolls 31, 33. A plurality of shower nozzles 35 is arranged in the cross direction (CD) for cleaning the wire (30). As used herein, the "wet end" forming portion of sheetmaking system 10 comprises headbox 8 and wire 30 and those sections before the wire 30, and the "dry end" comprises the sections that are downstream from wire 30. The wet end is also referred to as the fourdrinier section. As further described herein the dry end typically includes the press, drying, and finishing (or calendaring) sections.

Sheet 12 enters a press section 32, where the dehydration and thickening of the web takes place, and which includes multiple press rolls where sheet 12 travels through the openings (referred to as "nips") between pairs of counter-rotating rolls. In this way, the rolls in press section 32 compress the pulp material forming sheet 12. This may help to remove more water from the pulp material and to equalize the characteristics of the sheet 12 on both of its sides.

As sheet 12 travels over a series of heated rolls in dryer section 16, more water in sheet 12 is evaporated. At the finishing end, size press 17 and calendar 18 processes and finishes sheet 12, for example, by smoothing and imparting a final finish, thickness, gloss, or other characteristic to sheet 12. In particular, sizing operations provide paper with resistance to penetration by aqueous solutions. The chemical treatment also imparts better surface characteristics and improves certain physical properties. Sizing solution is applied within a two-roll nip 17. Other materials (such as starch or wax) can also be added to sheet 12 to obtain the desired finish. An array of induction heating actuators 24 applies heat along the CD to one or more of the rollers to control the roll diameters and thereby the size of the nips. Once processing by calendar 18 is complete, sheet 12 is collected onto reel 14.

Sheetmaking system 10 further includes an array of steam actuators 20 that controls the amount of hot steam that is projected along the CD. The hot steam increases the paper surface temperature and allows for easier cross directional removal of water from the paper sheet. Also, to reduce or prevent over drying of the paper sheet, paper material 13 is sprayed with water in the CD. Similarly, an array of rewet shower actuators 22 controls the amount of water that is applied along the CD.

In order to control the papermaking process, the properties of sheet 12 are continuously measured and the papermaking machine 2 adjusted to ensure sheet quality. This control may be achieved by measuring sheet properties using one or more scanners 26, 28 that are capable of scanning sheet 12 and measuring one or more characteristics of sheet 12. For example, scanner 28 could carry sensors for measuring the dry weight, moisture content, ash content, or any other or additional characteristics of sheet 12. Scanner 28 includes suitable structures for measuring or detecting one or more characteristics of sheet 12, such as a set or array of sensors. Scanner 28 can measure the dry end dry weight, ash content, or other physical properties of the paper product and generate dry-end signals. Measurements from scanner 28 are provided to control system 4 that adjusts various operations of papermaking machine 2 that affect MD and/or CD characteristics of sheet 12. An MD characteristic of sheet 12 generally refers to an average characteristic of sheet 12 that varies and is controlled in the machine direction.

In this example, control system 4 is capable of controlling the dry weight of the paper sheet by adjusting the supply of pulp to the headbox 8. For example, control system 4 could provide information to a stock flow controller that regulates the flow of stock through valves and to headbox 8. Control system 4 includes any hardware, software, firmware, or combination thereof for controlling the operation of the sheetmaking machine 2 or other machine. Control system 4 could, for example, include a processor and memory storing instructions and data used, generated, and collected by the processor. Scanner measurements control operations of the papermaking machine with both the dry end control and wet end control loops operating.

Figure 2:
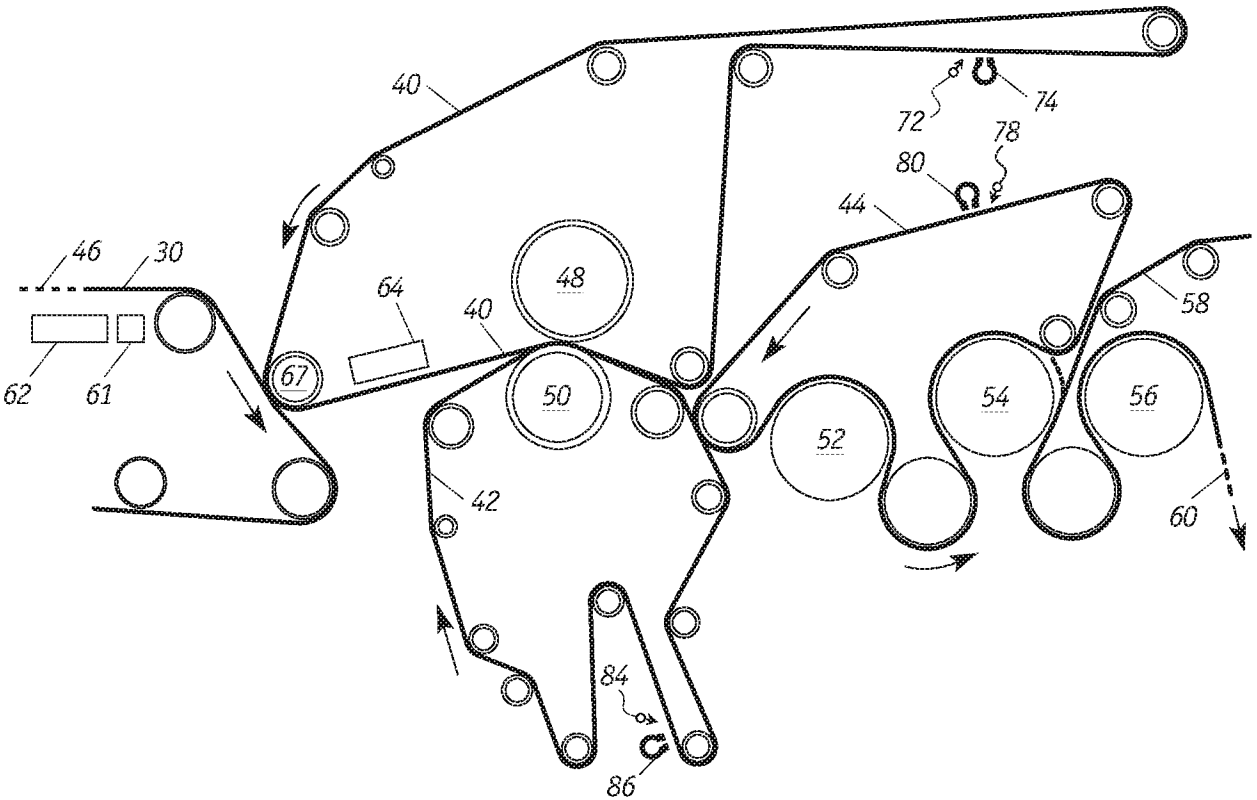

FIG. 2 depicts a representative press section which is situated between the end of the forming section and beginning of the dryer section. The press section consists of a number of cooperating endless circulating loops, through which a sheet of wet stock is transformed into a sheet of partially de-watered wet-stock. This exemplary press arrangement includes three separate closed loops that include: (1) upper press felt 40, (2) lower press felt 42, and (3) dryer felt 44. Press felts 40, 42 serve as reservoirs to collect (absorb) water from the sheet of wet stock by pressing and capillary action. The forming wires, press felts, and dryer felts are collectively referred to as papermaking clothing. Dryer felt 44 is heated and water evaporates from the partially de-water wet stock as it is carried by the dryer felt. Upper and lower press felt 40, 42 are typically made of synthetic materials whereas dryer felt 44 is typically made of cotton or synthetic materials. The structure of the felts used in the dryer section can have very high open areas to afford rapid evaporation. Coarse or grainy characteristics, chocking of felts, sticky materials on the felts, degraded porosity and excessive hardness on the press and dryer felts can cause marks or imperfections on the paper formed.

A sheet of aqueous wet stock 46 is transported from wire 30 of the forming section onto the wet-press section. A wet-end sensor 61 can measure characteristics of the wet stock 46 such as basis weight or caliper and generate wet-end signals. Vacuum devices 62, 64 referred to as Uhle boxes (vacuum boxes) under the wire and press felt remove water from the web. A sheet of wet stock 46 is transferred by suction to the bottom side of upper press felt 40 that is held by suction roll 62 and is thereafter retained and supported by surface tension on the upper press felt 40 as the sheet becomes disposed between the upper press felt 40 and the lower press felt 42. The sheet of wet of stock, which is sandwiched between the two felts, advances toward a press nip that is created by press rolls 48 and 50 where compression forces water from the wet stock and into the felts. Papermaking machine can have multiple press sections depending on the machine configuration. Upon exiting the wet-press step, the partially de-watered and consolidated sheet is transferred onto the first dryer felt 44 which carries and supports the sheet as it passes over dryer cylinders 52 and 54 where some residual water is removed by evaporation. The sheet is then transferred onto the second dryer felt 58 which is heated by dryer cylinder 56. Only one dryer cylinder is shown whereas a commercial papermaking machine typically has thirty to sixty, depending on the paper machine configuration. At this stage in the process, the relatively thin sheet dried paper product 60 is available for further papermaking processing, such as coating and calendaring, where the moisture content is reduced.

Dryer felts can be cleaned and washed in the process is generally referred as conditioning using chemicals and water. For example, a spray device 72 directs cleaning fluid onto the fabric and vacuum device 74 removes the cleaning fluid. Lower press felt 42 is similarly conditioned with spray device 84 and vacuum device 86 and dryer felt 44 is equipped spray device 78 and vacuum device 80. Typically each spray device includes a plurality of shower nozzles arranged in the CD adjacent the felt.

Figure 3:
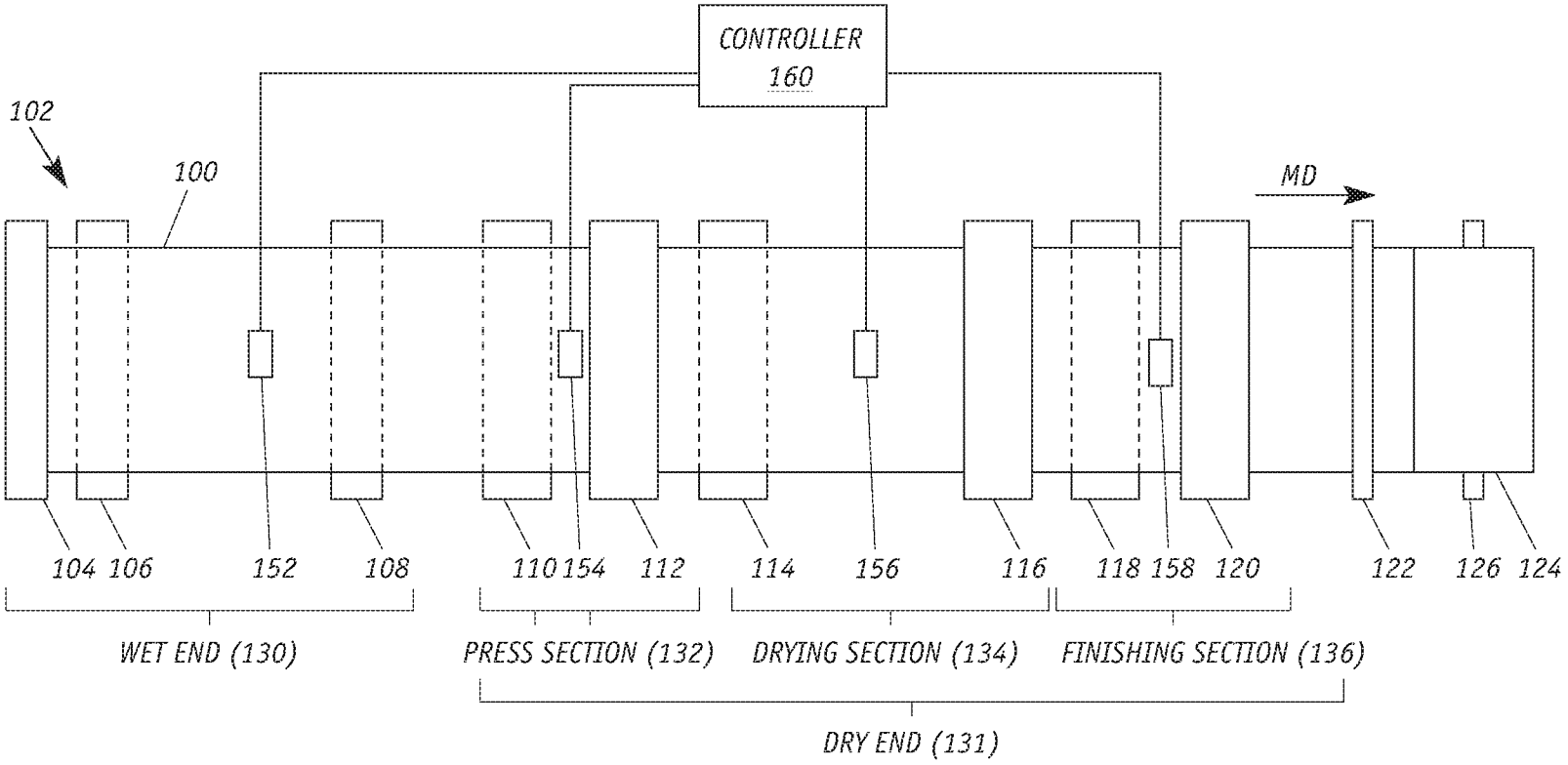

FIG. 3 is a schematic of the top view of a papermaking machine 102 with a wet end 130 and dry end 131 consisting of press section 132, drying section 134, and finishing section 136. Headbox 104 discharges a fibrous suspension onto a wire (not shown) to form a sheet or web of aqueous fibers 100 that is supported on the wire which is situated between rolls 106 and 108. Positioned above the web which is moving in the machine direction is camera 152. Press section 132 includes camera 154 that is positioned between rolls 110 and 112. Drying section 134 includes camera 156 that is positioned between rolls 114 and 116 and finishing section 136 includes camera 158 that is positioned between rolls 118 and 120. A slitter 122 shears the paper when jumbo reel 124 reaches a preselected size. Digital images of the web are taken by the cameras, such as CCD or CMOS devices, and the images are processed and recorded in computer controller 160. Instead of using cameras, an optical reflective or transmission sensor consisting of a laser and associated detector can be used to obtain information characteristics of the web.

With the present invention, components of the wet end 130 and dry end 131 that can produce repetitive defects on the web 100 are selected for analysis by creating diagnostic patterns associated with the components. The diagnostic patterns are compared with operational web defect patterns of the corresponding components to determine the source(s) of web defects that are detected. For instance, for wet end 130, a diagnostic pattern for the wire 30 (FIG. 1) can be generated by capturing images of the web at the web end when a new wire with no defects is used. The dimensions of diagnostic pattern for the wire are determined by the overall length of the wire circumference. Diagnostic patterns for rolls 106, 108 are captured and recorded by cameras 152 or with sensors. The dimensions of the diagnostic patterns for rolls are determined by their diameters. Similar diagnostic patterns are generated for components in the press, drying, and finishing (which includes the size press and calendar) sections. Another set of diagnostic patterns is also generated for the shower and spray arrangements in the wet and dry ends. They are used during production and during the cleaning or conditioning cycles. The dimensions of the diagnostic patterns are determined by the positions of the shower nozzles.

During operation of a papermaking machine, the quality control system (QCS) measures various physical properties of the paper, such as basis weight, thickness and moisture level, at different stages of the process. CD scanner sheet property measurements are stored for future reference and/or accessed for real-time observation and analysis. Other physical characteristics that can be measured include, for example: chemical composition, surface roughness, gloss, caliper, crepe pattern surface features.

Figure 4C:
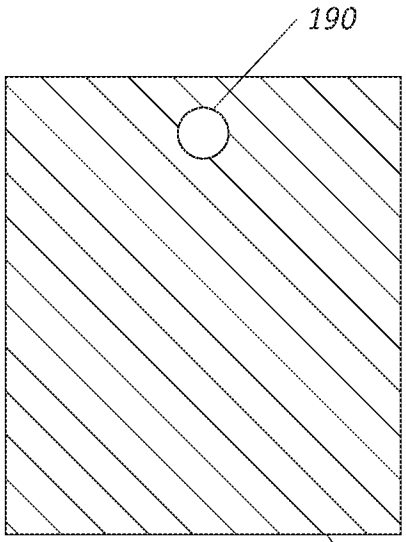
FIGS. 4A, 4B, and 4C are exemplary diagnostic patterns.

With the present invention, diagnostic patterns are created for selected components of the papermaking machine. FIG. 4A is a diagnostic pattern 180 for wire 30 (FIG. 1) at the wet end. The 2-dimensional pattern is created by using sensors data that measure one or more properties of interest of a moving web along a CD at a designated MD location at the wet end. The length of pattern 180 corresponds to the entire length of outer boundary or circumference of wire 30. The property levels can be measured when the wire 30 is new or just cleaned and is free of defects so that the diagnostic pattern represents the standard for a particular grade of paper being manufactured under specific operating conditions. Preferably, when the 2-D pattern 180 is created, the CD measurements are initiated at specific and recorded location of wire 30. In this fashion, each position in the 2-D pattern of the web can be associated with an identifiable position on the wire.

If defects are present in wire 30, such as a hole in the wire mesh or the presence of a foreign material, then the diagnostic pattern will exhibit corresponding web sheet deviations from standard that are caused by said defects. In this example, the presence of deviation 182 on the diagnostic pattern 180 suggests that there is a corresponding defect on wire 30. Moreover, the specific locations of the defects on the wire can be identified. These defects on the wire are considered the root causes of the corresponding web-sheet deviations. Defects on wire 30 will cause repeated deviations on the moving web as the endless wire continues to operate.

Figure 4B:
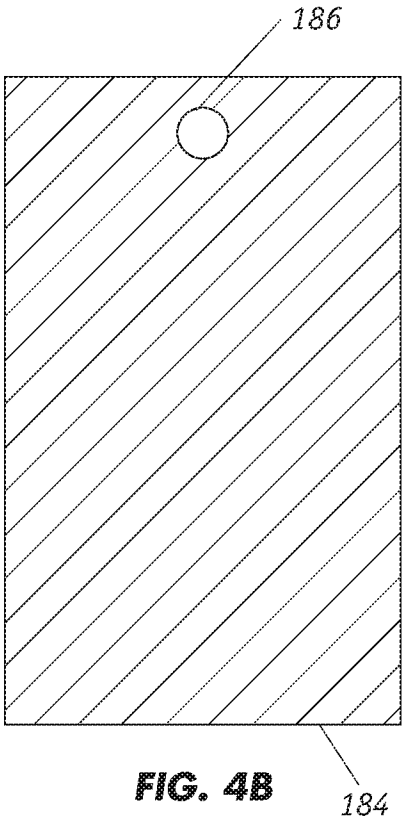
Figure 4A:
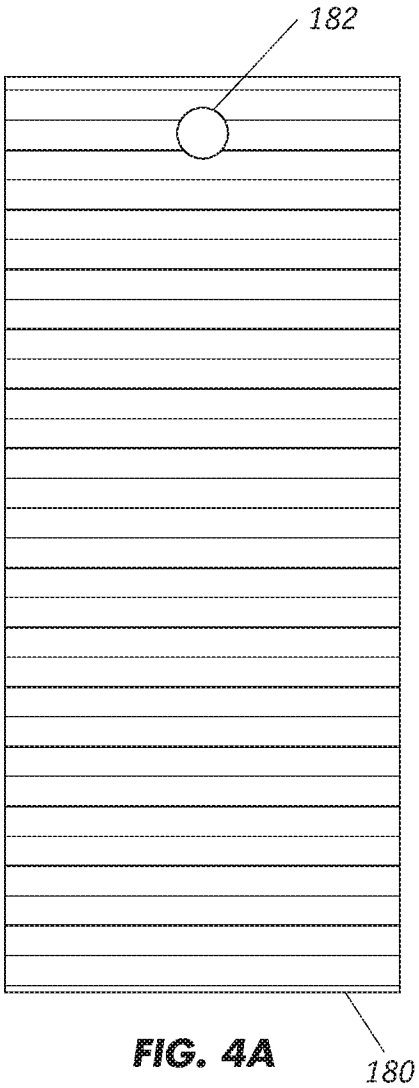

Similarly, FIG. 4B is a diagnostic pattern 184 for press felt 40 (FIG. 2). The 2-D is created by sensors data that measure one or more properties of interest of a moving web along a CD at a designated MD location at press end. The length of pattern 184 corresponds to the entire length of outer boundary or circumference of press felt 40. For instance, the pattern can represent the preferred moisture levels or thicknesses of a web of fibrous stock exiting the press section. Defects in the press felt will result in repeated deviation 186 on the web.

FIG. 4C is a diagnostic pattern 188 for a roll such as size press 17 or calendar 18 (FIG. 1). The 2-D is created by sensors data that measure one or more properties of interest of a moving web along a CD at a designated MD location at finishing end. The length of pattern 188 corresponds to the entire length of outer boundary or circumference of a roll. For instance, the pattern can represent the preferred thicknesses or gloss of a web of dried paper. Defects in the press or calendar generate corresponding repeating deviations 190 on the web.

There are many potential sources of web quality deviations in the papermaking process. For example, with respect to deviations in web thickness, potential sources are present throughout the machine from the headbox to the finishing end. In the case of gloss deviations, the potential sources are most likely located at the finishing end where calendaring and added coatings produce glossy paper. The present invention affords a technique to identify the source(s) of repetitive web defects.

Both during production and cleaning, web inspection system defect identification sensors capture defects of the web to create operational patterns that are compared to the diagnostic patterns. In addition, the papermaking machine quality control system, which measures physical properties and optimizes the machine, is also operating and integrated with the web defect detection, classification and identification process. FIG. 5B is a cross-directional profile or scan of a representative physical property such as web caliper or basis weight at one location along the machine direction. The upper and lower profiles represent the acceptable range or standard for the physical property.

Figure 5A:
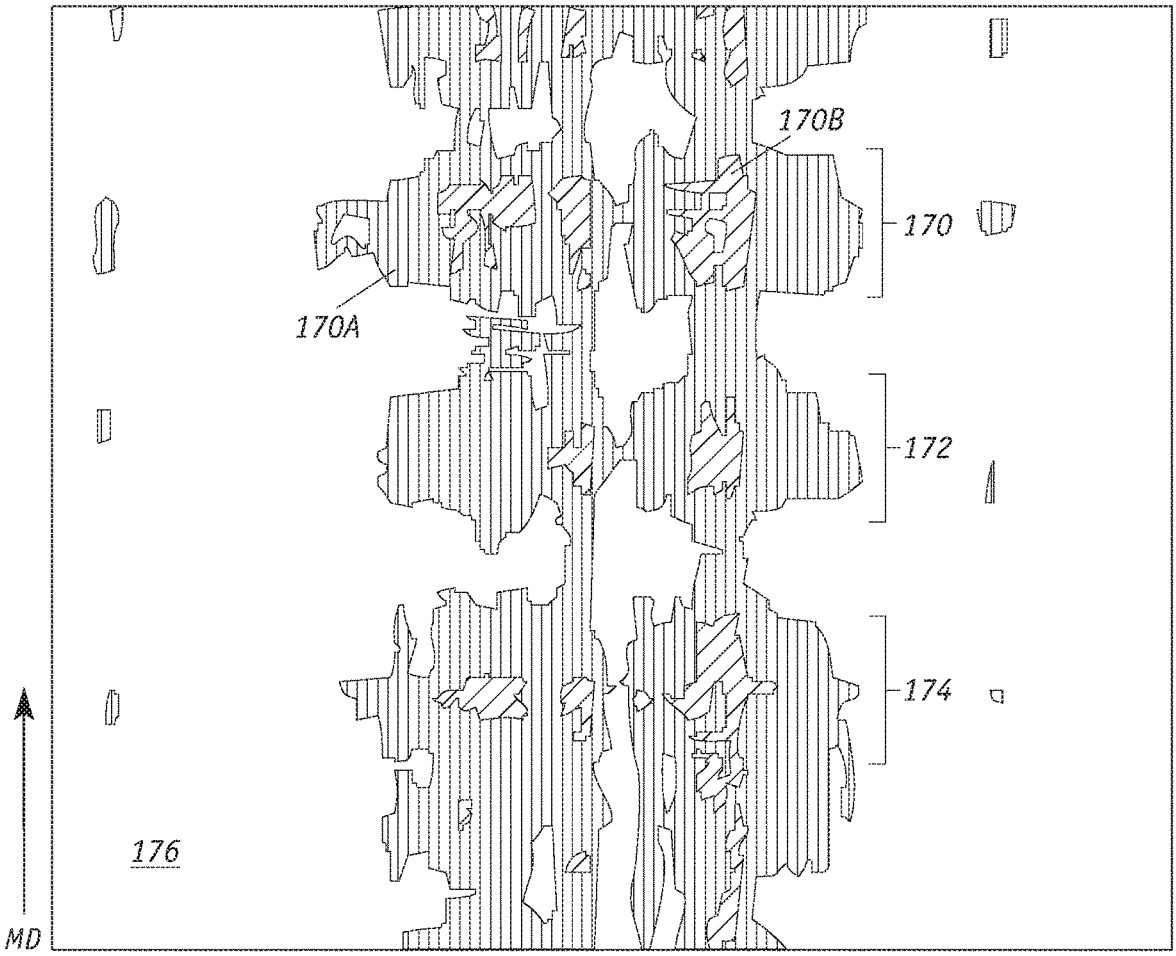
FIG. 5A depicts measurements of a web sheet characteristic that are presented in a two-dimensional map format.
Figure 5B:
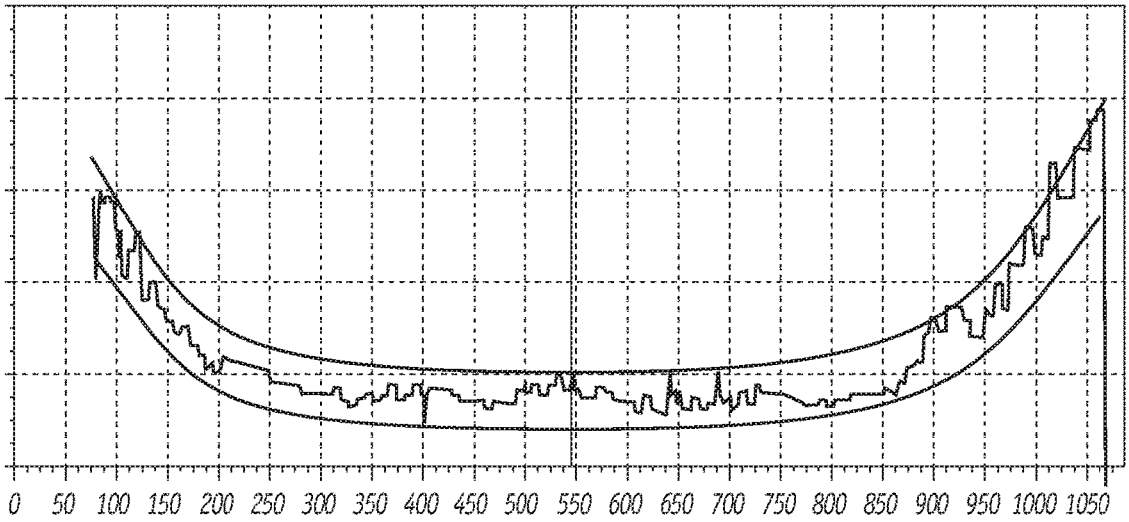
FIG. 5B is a cross directional profile of a web sheet characteristic.

FIG. 5A shows a map which is a compilation of CD measurements vs. standard over a period of time. The most recent scan is at the bottom and the oldest one on top. The map depicts regions where the measured parameters are within specification. The map also depicts successive regions 170, 172, and 174 of the moving web exhibiting quality deviations from standard. Moreover, each area encompasses acceptable and non-acceptable portions. For example, within the web portion designated 170A, the quality is within a tolerance range whereas the web portion designated 170B represent web where the quality with respect to the measured property is not acceptable. The data represented in FIG. 5A correlate to defects in the moving web along the MD with respect to the papermaking machine. In practice, for ease of observation, the measurement values are usually represented by different colors.

Figure 6:
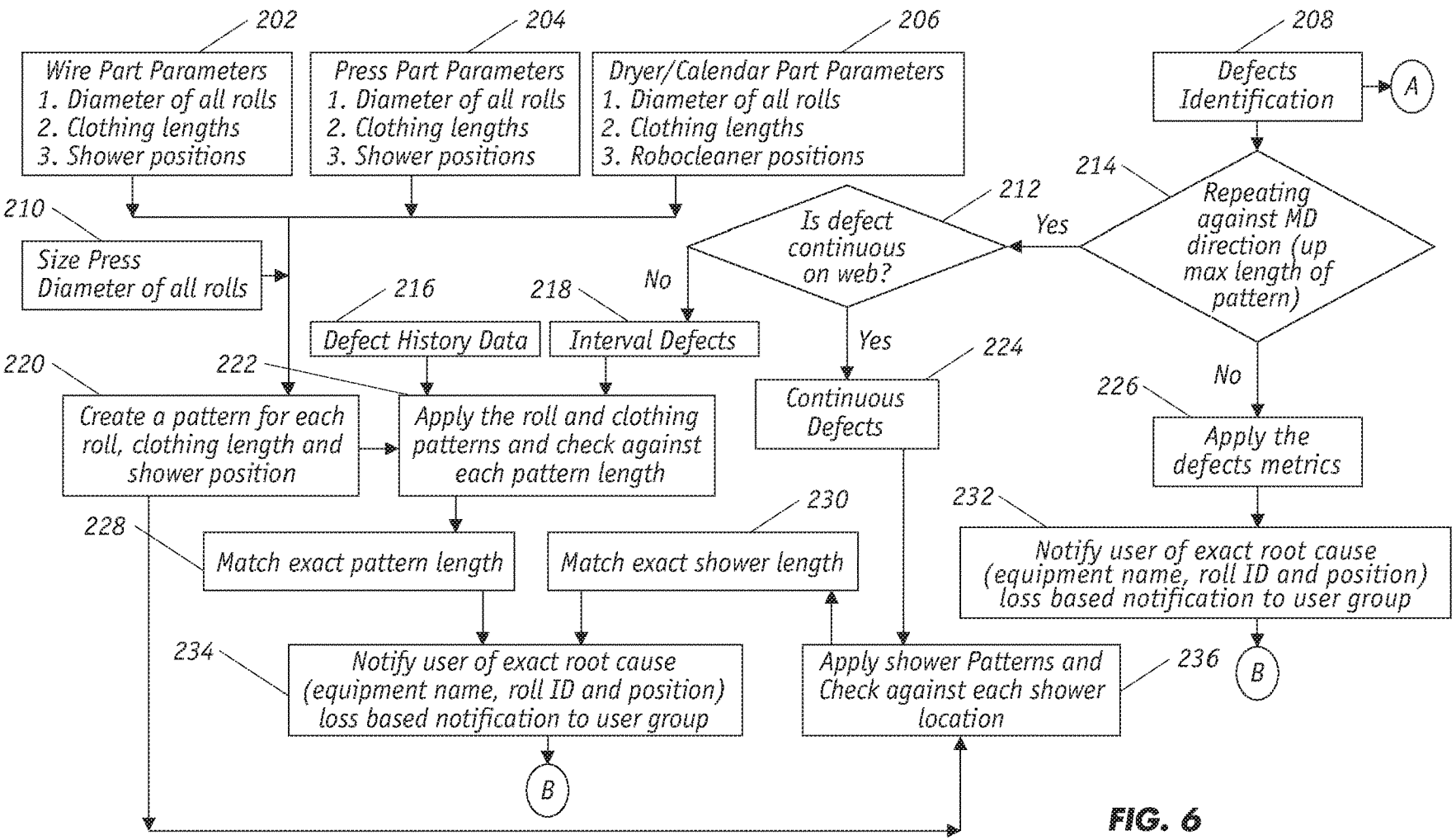
FIG. 6 is a flow diagram for identification of root cause of a defect.

FIG. 6 shows the steps in the process of identifying the cause(s) of paper defects generated during production. Diagnostic patterns (220) are created for selected wire parameters (202), press parameters (204), dryer/calendar parameters (206) and size press (210). Clothing refers to the wire at the wet end and felts at the dry end. Robo-cleaner refers to automatic cleaning mechanism in the dryer and felts. Diagnostic patterns are created for (i) selected rolls based on their diameters, (ii) clothing based on their lengths, and (iii) cleaning devices based their shower nozzle locations.

At step 208, web defect data is collected and analyzed as illustrated in FIG. 5A. In steps 214 and 212, quality deviations and defects are classified as repetitive defects or non-repetitive defects in the machine direction. Using standard pattern recognition software, the information in FIG. 5A and in particular, the regions exhibiting web deviations is analyzed and each region is classified as being a repetitive defect or non-repetitive (interval) defect in the machine direction. In FIG. 5A, regions 170, 172, and 174 represent repetitive or cyclical defects. A partitional clustering algorithm such as a K-means clustering algorithm can be employed to determine the right group or category to which repetitive defects belong. Repetitive defects are further classified in steps 224 and 218 into two categories: continuous web defects and non-continuous (or interval) web defects in steps 218, 220 and 224. For example, moisture lines and groove impressions from rolls and dryers appear as continuous web defects. Holes, calendar stamping, size press impressions are examples of non-continuous web defects.

As shown in steps 212, 228, 216, and 218, web defects on a moving web are classified as continuous web defects or non-continuous web defects. For a web with repeating defects that are non-continuous, diagnostic patterns for the rolls and clothing (including wire and felts) are compared to the repeating defects. The diagnostic pattern which matches the exact length of the repeating defect is identified. A technique for correlating the detected dynamic and deterministic web defect patterns to circulating web machine components uses a naïve bayes statistical machine leaning technique. The probability method uses prior data to identify the machine component(s) or root causes of web defects. The Baysian model is constructed using information relating to machine component defects history data, machine parameters, and felt/wire/equipment replacement or reconditioning times and dates. The model applies historical data and when new data relating to defect incidences becomes available, the model prioritizes the equipment from where the defect(s) originate.

The unique features of the identified diagnostic pattern in turn yield information as to the specific component causing the defect. In steps 236, 230, 234, for a web with repeating defects that are continuous, shower and robo-cleaner patterns are applied and the diagnostic nozzle pattern which matches the exact length of the repeating defects is found and the identity and location of the cause of the defect are determined. In step 234, once a solution is generated and operator of papermaking machine is notified of cause and solution. As specified in steps 226, 232, for non-repetitive web defects, the defects are matched using conventional fault location metrics to identify the equipment(s) causing the non-repetitive web defects. For continuous web defects, when comparison shows a match in the exact pattern length and/or exact shower length, machine operator is notified (234).

Once the papermaking machine component(s) causing web defects are known, the operator can execute a number of solutions to remedy the situation. Re-trim removes selected defective portions of the material from the jumbo reel. In most papermaking operations, the jumbo reel is rewound into small paper rolls or to form another reel for coating, treatment or converting. As part of the re-winding operations, defective paper is removed.

As indicated in steps 208 and 228, when web defects are identified on a moving web, distance along the MD of the defects to the jumbo reel 14 (FIG. 1) are recorded as an input on the reel's length. When the web material is wound onto the reel, this synchronization procedure marks the locations, including the starting points, on the reel where web material containing defects can be found. The removed defective paper can be sold as paper of a lower grade.

When web defects are detected, control system 4 (FIG. 1) can initiate appropriate action to remove or minimize the defect. For example, if the defect in caused by tacky material on the wire mesh or felt, the foreign substance may be easily removed by application of an on-line spray. In the case where the web defects are caused by an upstream machine defect, it may be possible to minimize or correct the defect by the appropriate adjustments of actuators located downstream. For instance, if a slice in the headbox 8 malfunctions so that the sheet of aqueous wet stock 46 transported from wire 30 (FIG. 2) has an unacceptable CD thickness measurement, then one or more of the presses or rolls downstream can be adjusted so that the final product is within specification with respect to caliper. For either of these scenarios, it desirable to record when web defects first appear and when the defects cease. Finally, in some instances where web defects are caused by machine components that cannot be fixed online or where the web defects are too severe to be corrected, then the only effective remedy is to replace the defect machine parts.

Figure 7:
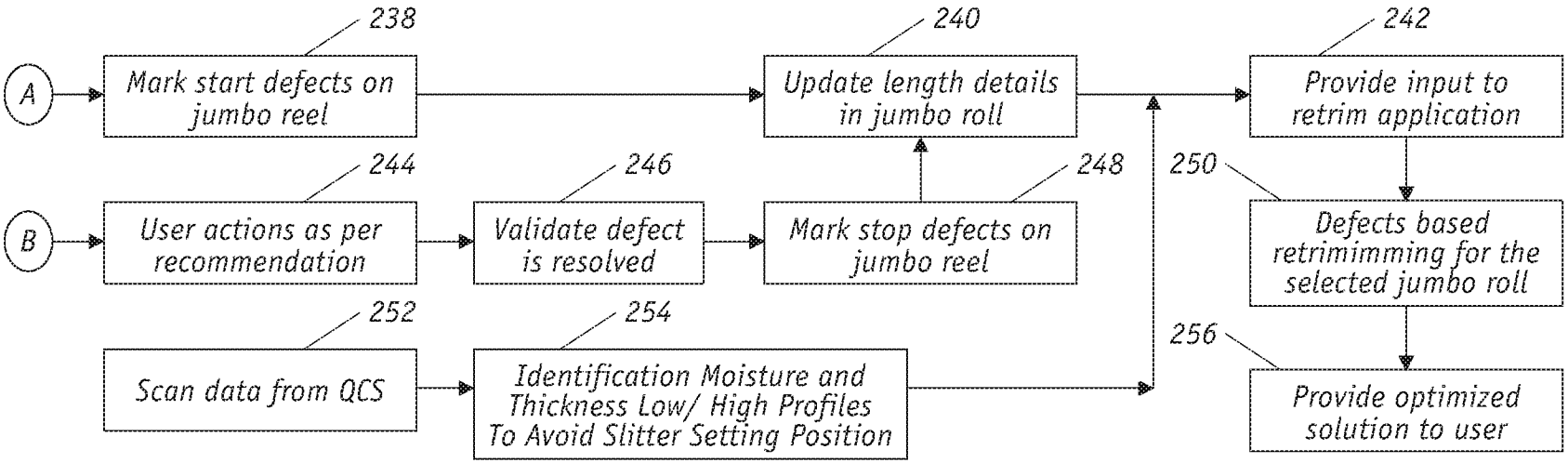
FIG. 7 is a flow diagram for automatic re-trimming of a defective jumbo roll.

The jumbo roll 14 (FIG. 1) is the parent roll that is manufactured and is typically undergoes a rewinding process whereby the parent roll is unwound, cut and wind into suitable size rolls. Defective material in the jumbo roll is identified and removed in a re-trimming process shown in FIG. 7. When a web defect is first detected, its location along the machine direction is recorded and simultaneously the anticipated location of the initial web defect in the jumbo rolls is noted. Since the machine speed is known, the time required for the initial web defect to reach the jumbo roll can be determined. In this fashion, the position of the initial web defect relative to the length of the roll can be marked in step 238. Once the web defect is removed, the position of when the defect ceases to appear relative to the length of the roll is also remarked in step 240.

Moisture and thickness profiles are also analyzed in step 252. The locations on the jumbo roll where moisture and thickness profile deviations occur, that is, the positions along the length of the paper where such defects are found are inputted in control system in step 254. These defects are also removed during re-trimming. In steps 244, 246, and 248, the operator takes appropriate corrective action. The initial appearance and cessation of web defects are marked on the jumbo roll. When the roll is unwound, the defective paper in the jumbo reel is removed or trimmed in steps 242, 250 and 256.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A process to monitor characteristics of web defects which are continuously generated on a moving web, which is moving in a machine direction (MD), and that is in contact with circulating machine components of a circulating web machine during production and to identify the causes of the web defects, which process comprises:

(a) identifying at least one circulating web machine component that can generate corresponding web defect patterns on a continuously moving web of material;

(b) creating one or more diagnostic patterns for the at least one circulating web machine component identified in step (a);

(c) detecting dynamic and deterministic web defect patterns on the continuously moving web of material during production;

(d) identifying the locations along the MD of the dynamic and deterministic web defect patterns on the continuously moving web of material;

(e) classifying the detected dynamic and deterministic web defect patterns in step (c) to determine whether the detected web defects are repetitive or non-repetitive;

(f) correlating detected dynamic and deterministic web defect patterns to at least one circulating web machine component using the one or more diagnostic patterns created in step (b), wherein step (f) is applied only to dynamic and deterministic web defects that are repetitive; and (g) determining a source of the detected dynamic and deterministic web defect patterns.

2. The process of claim 1 further comprising step (h) of classifying the dynamic and deterministic web defect patterns as being continuous or non-continuous.

3. The process of claim 1 wherein step (f) uses pattern recognition to compare the detected dynamic and deterministic web defect patterns to the one or more diagnostic patterns.

4. The process of claim 1 wherein step (f) employs a naïve bayes statistical machine learning technique.

5. The process of claim 1 wherein the circulating web machine produces a continuous flat sheet material that is selected from the group consisting of paper, metal, rubber, plastic and packaging.

6. The process of claim 1 wherein the at least one circulating machine component is selected from the group consisting of a circulating endless wire, a circulating endless cloth or felt, a press, a rotating roll, shower position or cylinder, and combinations thereof.

7. The process of claim 1 wherein the at least one circulating machine component engages and shapes the continuously moving web of material.

8. The process of claim 1 further comprising step (h) of initiating corrective actions to (i) eliminate the source of the detected dynamic and deterministic web defect patterns, (ii) adjust operating parameters of the circulating web machine, and/or (iii) remove web material that contains defects from finished product.

9. The process of claim 1 wherein the circulating web machine has a circulating endless wire and wherein:

step (a) comprises identifying a rotatable component of the circulating web making machine, that can impart corresponding repetitive web defects onto a continuous moving web of material;

step (b) comprises developing a diagnostic pattern for the actuator identified in step (a);

step (c) comprises detecting web defects on a continuous moving web material;

step (e) comprises analyzing the detected web defects in step (c) to determine whether the detected web defects are repetitive or non-repetitive;

step (f) comprises comparing the diagnostic pattern to detected web defects that are repetitive; and step (g) comprises identifying a source of web repetitive defects.

10. The process of claim 9 wherein:

step (a) comprises of identifying (i) a wet end rotatable component that can impart repetitive wet end web defects onto a continuous moving aqueous web of material and/or (ii) identifying a dry end rotatable component that generates dry end repetitive defects onto a continuous dried web of material;

step (b) comprises of developing a diagnostic pattern for the actuator(s) identified in step (a); and step (c) comprises of detecting wet end web defects on the continuous moving aqueous web material and/or detecting dry end web defects on the continuous moving dried web material.

11. The process of claim 10 wherein the wet end rotatable component comprises an endless circulating wire mesh and the dry end rotatable component is selected from the group consisting of a circulating endless cloth or felt, a press, a rotating roll or cylinder, and combinations thereof.

12. The process of claim 10 wherein step (c) comprises of (i) obtaining images of the continuous moving aqueous web of material and/or the continuously moving dried web of material or (ii) measuring a physical characteristic of the continuous moving aqueous web of material and/or the continuously moving dried web of material.

13. A monitoring process for a continuous web making machine having a wet end which includes a circulating endless wire on which a continuous aqueous sheet of material is formed and a dry end which includes a plurality of devices that transform the continuous aqueous sheet of material that is moving in a machine direction (MD) into a continuous dried sheet product, wherein the monitoring process comprises:

(a) identifying a rotatable component of the continuous web making machine, wherein the rotatable component is selected from the group consisting of a circulating endless wire mesh, a circulating endless cloth or felt, a press, a rotating roll or cylinder, that can impart corresponding repetitive web defects onto a continuous moving web of material;

(b) developing a diagnostic pattern for the rotatable component identified in step (a);

(c) detecting web defects on a continuous moving web material during production;

(d) analyzing the detected web defects in step (c) to determine whether the detected web defects are repetitive or non-repetitive;

(e) comparing the diagnostic pattern to detected web defects that are repetitive; and (f) identifying a source of web repetitive defects.

14. The monitoring process of claim 13 wherein:

step (a) comprises of identifying (i) a wet end rotatable component that can impart repetitive wet end web defects onto a continuous moving aqueous web of material and/or (ii) identifying a dry end rotatable component that generates dry end repetitive defects onto the continuous dried web of material;

step (b) comprises of developing a diagnostic pattern for the rotatable component identified in step (a); and step (c) comprises of detecting wet end web defects on the continuous moving aqueous web material and/or detecting dry end web defects on the continuous moving dried web material.

15. The monitoring process of claim 14 wherein the wet end rotatable component comprises an endless circulating wire mesh and the dry end rotatable component is selected from the group consisting of a circulating endless cloth or felt, a press, a rotating roll or cylinder, and combinations thereof.

16. The monitoring process of claim 14 wherein step (c) comprises of (i) obtaining images of the continuous moving aqueous web of material and/or the continuously moving dried web of material or (ii) measuring a physical characteristic of the continuous moving aqueous web of material and/or the continuously moving dried web of material.

17. The monitoring process of claim 14 further comprising step (g) of initiating corrective actions to (i) eliminate the source of web repetitive defects, (ii) adjust operating parameters of the web making machine and/or to retrim a final web product that is made.

* * * * *